US006883882B2

(12) United States Patent
Lin

(10) Patent No.: US 6,883,882 B2
(45) Date of Patent: Apr. 26, 2005

(54) CABINET ASSEMBLY

(75) Inventor: Yavulas Lin, Taichung (TW)

(73) Assignee: UMA Team Enterprise Co., Ltd., Taichung (TW)

( * ) Notice: Subject to any disclaimer, the term of this patent is extended or adjusted under 35 U.S.C. 154(b) by 5 days.

(21) Appl. No.: 10/428,138

(22) Filed: May 2, 2003

(65) Prior Publication Data

US 2004/0217678 A1 Nov. 4, 2004

(51) Int. Cl.[7] ..... A47G 29/00

(52) U.S. Cl. ..... 312/265.5; 312/263; 312/257.1; 108/193; 108/180; 108/101

(58) Field of Search ..... 108/101, 180, 108/193; 312/257.1, 263, 265.5

(56) References Cited

U.S. PATENT DOCUMENTS 4,128,284 A * 12/1978 King ..... 312/348.2
4,468,067 A * 8/1984 Jenkins ..... 312/140
4,600,252 A * 7/1986 Barber ..... 312/263
4,807,948 A * 2/1989 Baus ..... 312/258
4,883,331 A * 11/1989 Mengel ..... 312/195
5,921,646 A * 7/1999 Hwang ..... 312/263
5,947,037 A * 9/1999 Hornberger et al. ..... 108/115

FOREIGN PATENT DOCUMENTS

FR 12590334 * 11/1985

* cited by examiner

*Primary Examiner*—Laurie K. Cranmer
(74) *Attorney, Agent, or Firm*—Troxell Law Office, PLLC

(57) ABSTRACT

The present invention discloses an improved cabinet assembly comprising more than one flat piece and a curved connecting member; wherein a latch is disposed on the edge of the flat piece, so that the flat pieces and the connecting member are engaged and connected by means of the latch member to form a rack with curved edges in various combinations.

3 Claims, 6 Drawing Sheets

CABINET ASSEMBLY

BACKGROUND OF THE INVENTION

1. Field of the Invention

The present invention relates to an improved cabinet assembly, more particularly to a cabinet that can be assembled with different configurations for storing objects.

2. Description of the Related Art

As science and technology makes our life more convenient and easier nowadays, more and more people are seeking for a natural life and the good old days, and thus bringing back a wave in search for antiques. It does not only apply to our daily products, but also to furniture. The furniture, television, or refrigerator simulated those of the 50' have curved edges and corners, bringing a wave to the design of the cabinet. Please refer to FIG. 1 for the prior-art cabinet simulating those in the 50', in which a wooden board 110 is cut into a predetermined size in advance, and such wooden boards 110 are glued together, and then a model 100 is used to bend such wooden boards 110 into a rack. The method of applying high-frequency pressurization and heating is adopted to harden the glue and fix the wooden boards 110 into the desired shape, and joints are connected to assemble a cabinet. Such arrangement not only wastes time and effort, but also has a shortcoming that the size of materials used must be calculated first, otherwise we will not able to assemble the cabinet in the assembling process. Furthermore, the transportation occupies much space since the rack cannot be disassembled.

Please refer to FIG. 2 for another structure. In the figure, curved upper and lower edges of a side board are prepared in advance, and a tenon is used to connect such side boards. However, it is necessary to fix the width of the upper and lower edges for preparing such side boards. Although the height of the cabinet can be altered anytime, the width is limited, which is not too good for the use either.

In view of these shortcomings of the prior-art cabinet wasting time and effort, occupying storage space, being unable to change its volume as we wish and inconvenient in use, the inventor of the present invention based on years of experience accumulated from the engagement in the related industry conducted extensive research to resolve the aforementioned shortcomings and invented the improved cabinet assembly in accordance with the present invention.

SUMMARY OF THE INVENTION

The primary objective of the present invention is to provide an improved cabinet assembly, in which several flat pieces are erected in different directions and a curved connecting member is disposed between such flat pieces; a latch member is disposed on the corresponding position of the connecting member so that the latch member can connect several flat pieces and the connecting member together to form a rack with various configurations for storing objects.

Another objective of the present invention is to provide an improved cabinet assembly, of which a main body is disposed on a connecting member, and such main body at least has a rib and a cover board such that the strength of the main body can be enhanced during its use by the support of the rib.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
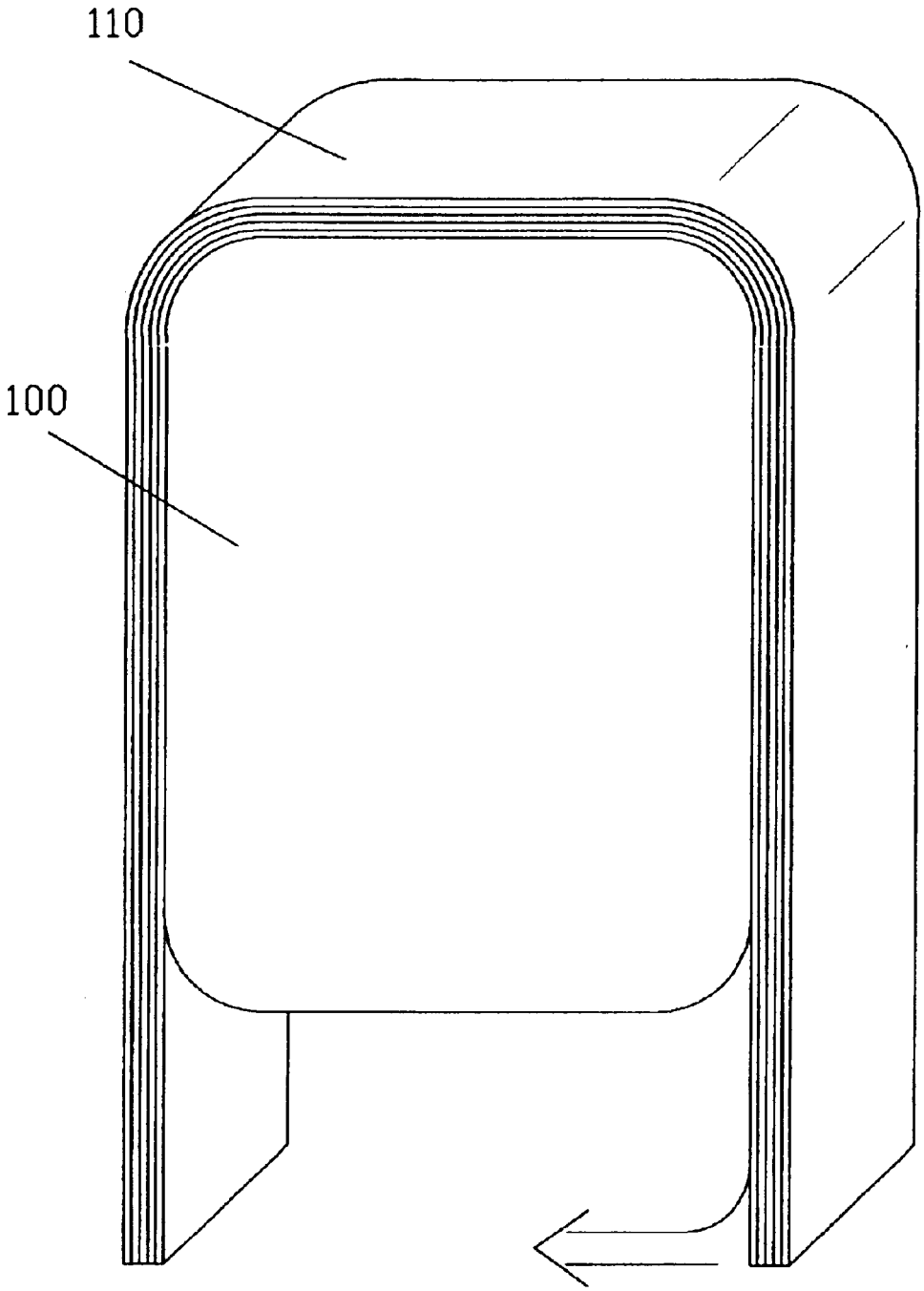
FIG.1 Prior Art
FIG. 1 is an illustrative diagram of the assembled cabinet of the prior art.
Figure 2:
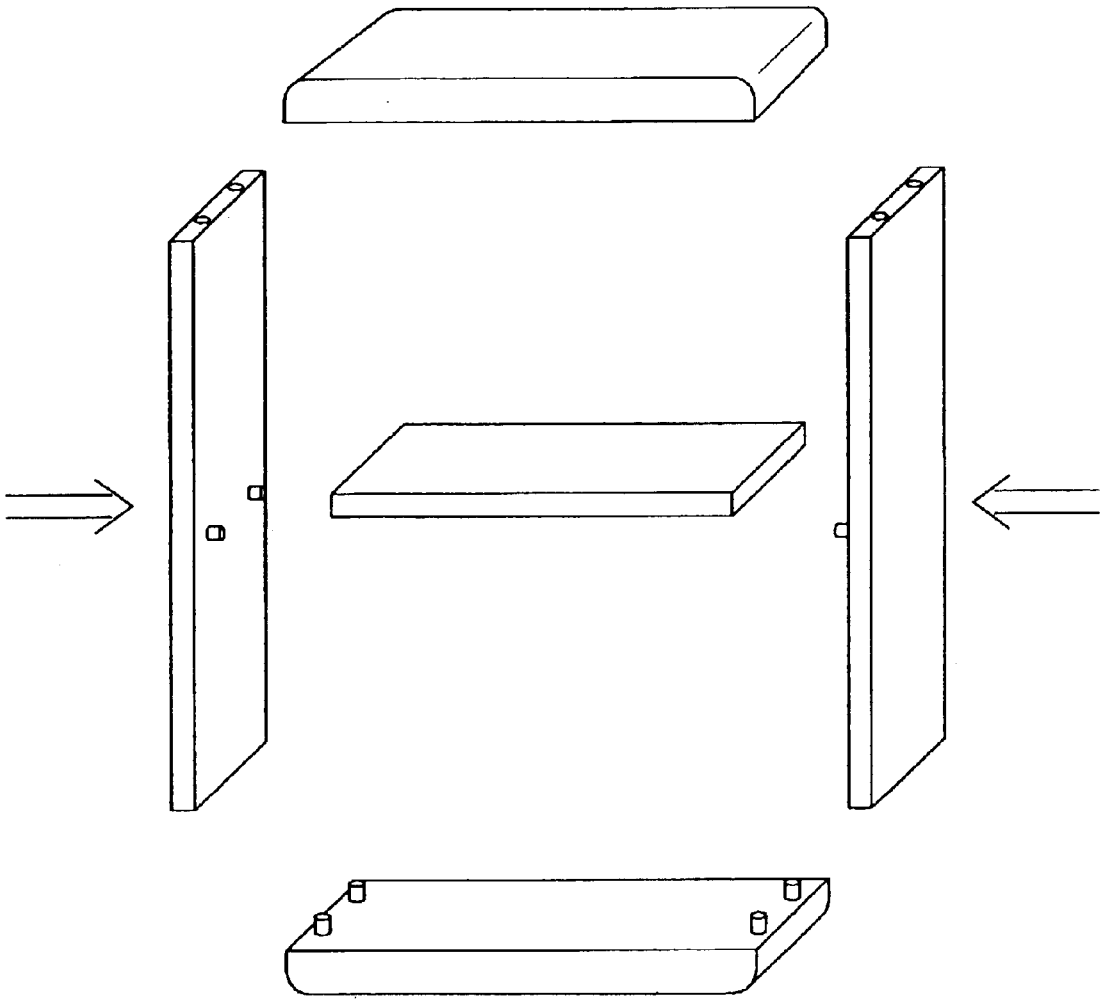
FIG.2 Prior Art
FIG. 2 is a perspective diagram of the disassembled parts of the cabinet according to another embodiment of the prior art.
Figure 3:
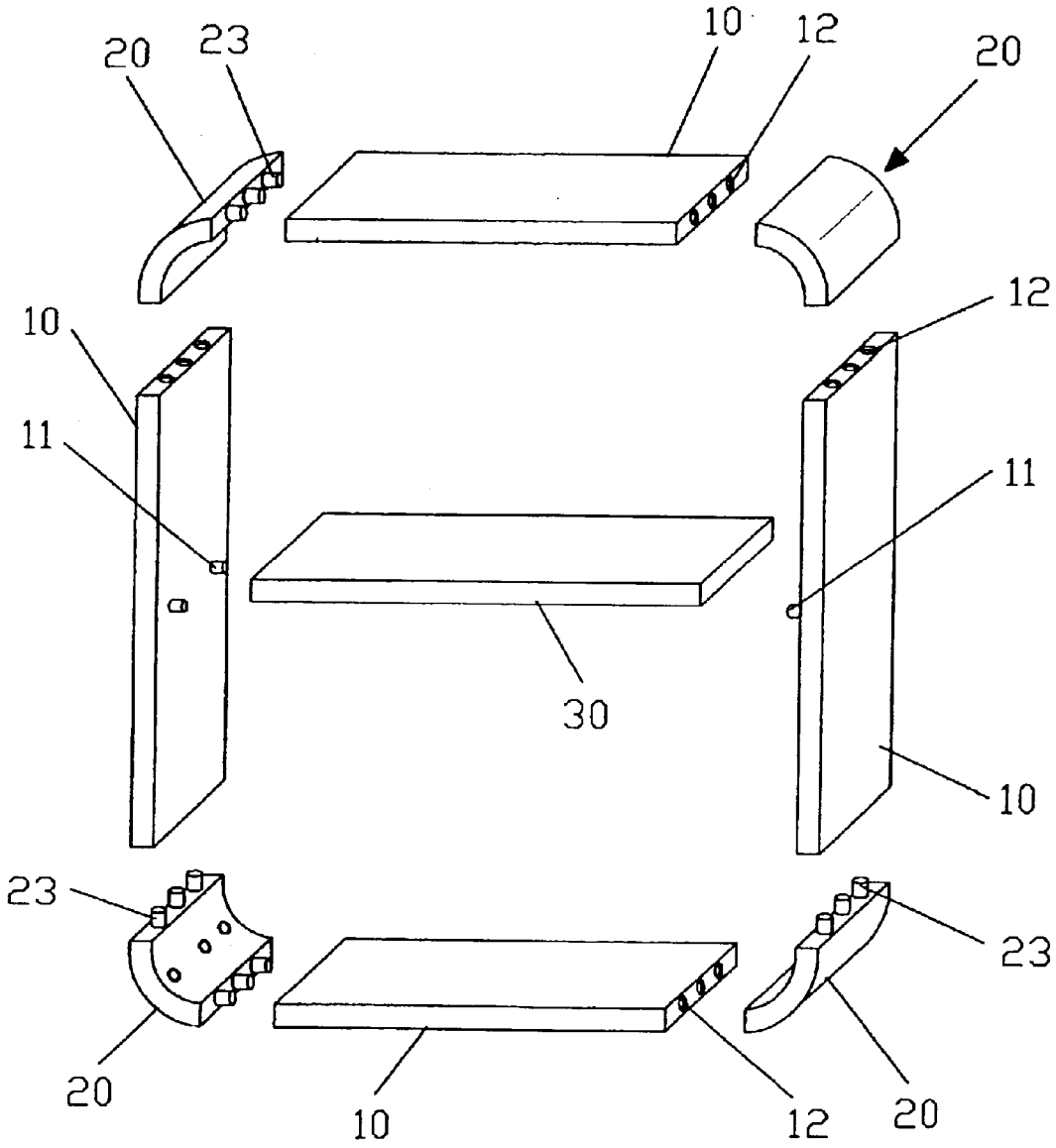
FIG. 3 is a perspective diagram of the disassembled parts of the cabinet according to the present invention.

Please refer to FIG. 3 for a cabinet assembly according to the present invention, which comprises a plurality of flat pieces 10 erected in different directions and a connecting member 20; wherein the flat piece 10 is a board with specific length, and the flat piece has a fixing protruded pillar 11 disposed at a specific position, and the end of the flat piece 10 respectively has a latch member 12 (which is a fillister in this embodiment, but the person skilled in the art may use other components to substitute the fillister). The connecting member 20 is substantially curved in shape. Please refer to FIG. 5 Such connecting member 20 has a main body 21 with a cross section substantially in an arc shape, and such main body at least has a rib 22 each connected to both sides of the main body 21. The end of the main body 21 respectively has a latch member 23 (which is a protruded pillar in this embodiment) to work together with the latch member 12 of the flat piece 10. Further, a cover board 24 in corresponding shape is covered on the main body 21.

Figure 4:
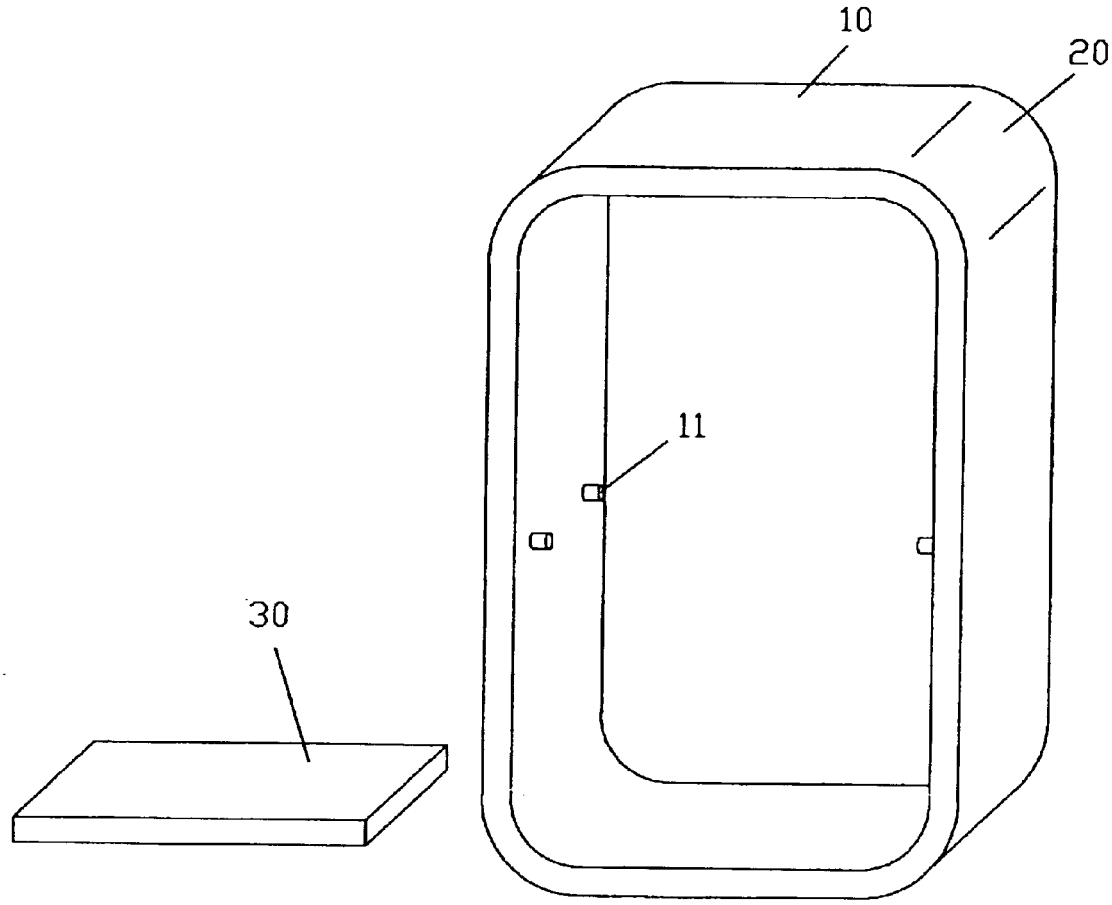
FIG. 4 is an illustrative diagram of the assembled cabinet of the present invention.
Figure 5:
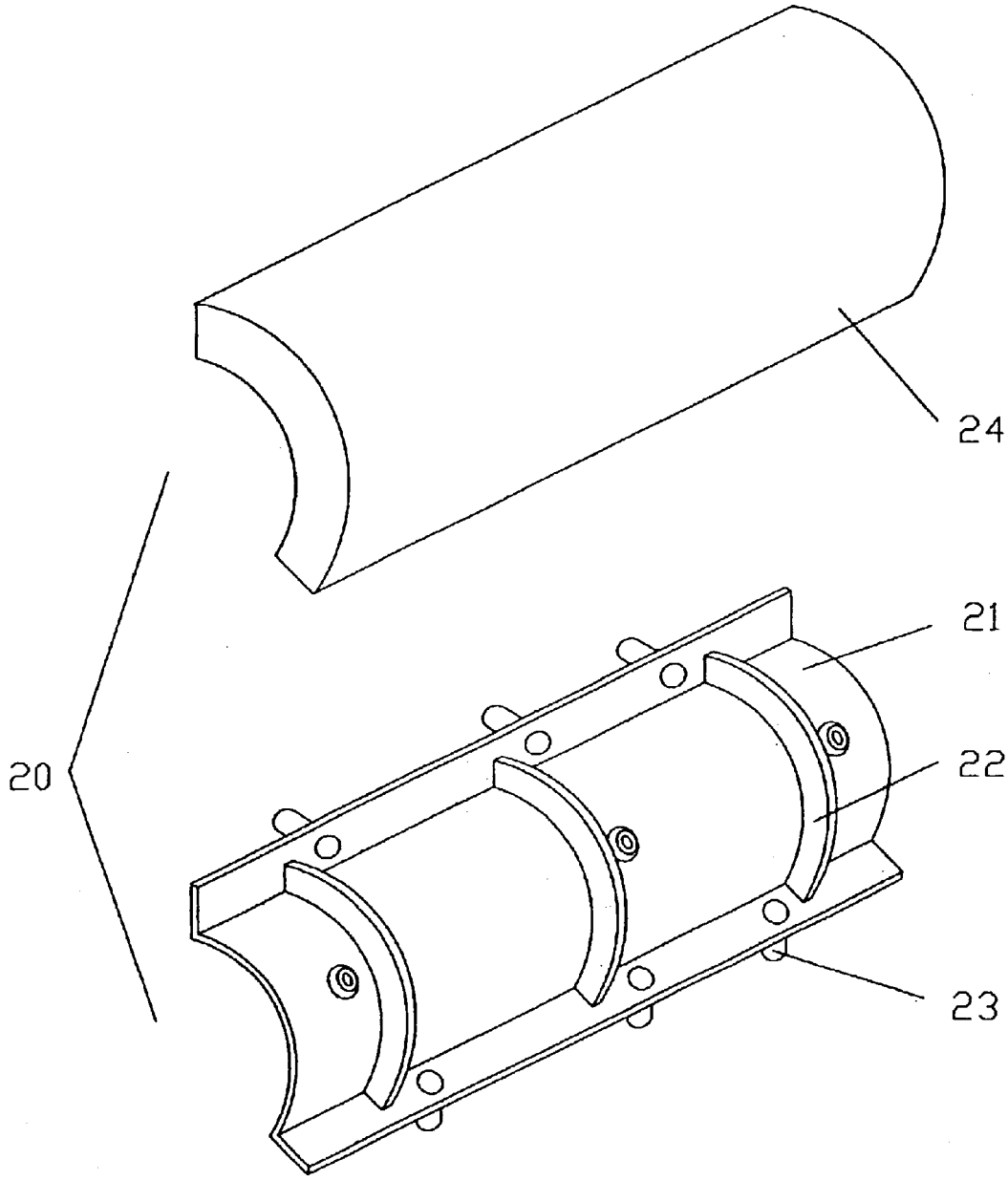
FIG. 5 is a perspective diagram of the disassembled connecting member according to the present invention.
Figure 6:
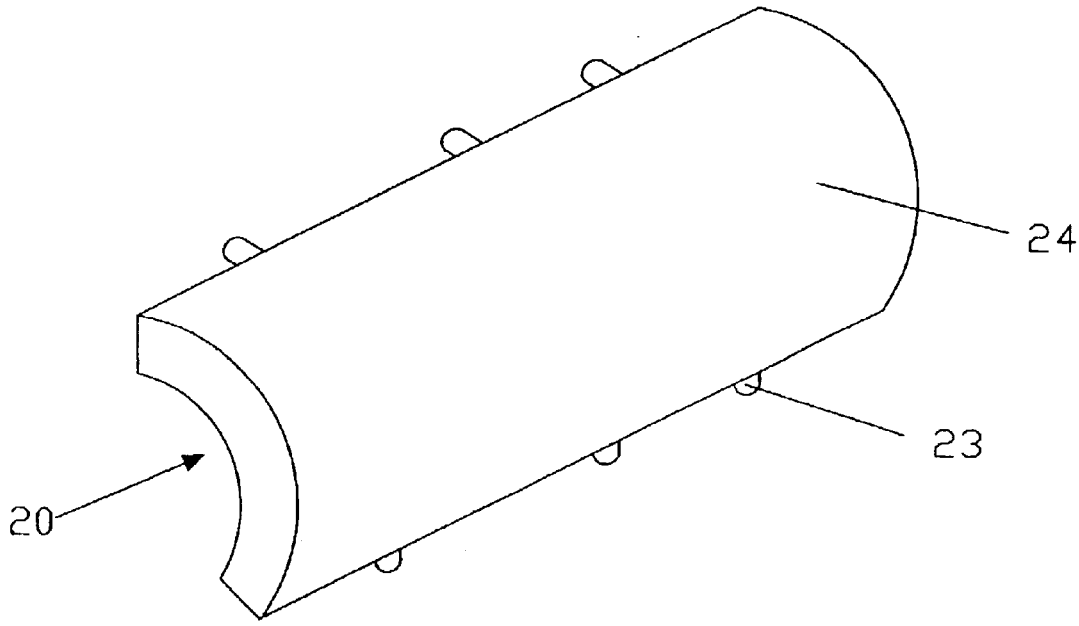
FIG. 6 is a perspective diagram of the connecting member according to the present invention.

Further, please refer to FIGS. 3, 4, and 5. The flat pieces 10 are placed in different directions (in the left, right, up, and down directions in this embodiment) during the assembling, and the assembled connecting member 20 (as shown in FIG. 6) is placed between two flat pieces 10. A latch member 12, 23 is latched to connect the connecting member 21 and the flat piece 10 together. After a rack is formed, a partition board 30 is placed on the fixing protruded pillar 11 of the flat piece 10 to separate the rack into several partitions for storing objects. Such arrangement not only allows the flat piece 10 to continuously connect to other flat pieces by the latch member 12, and also connects the connecting member 20 together by the latch member 23 to form a rack of variable lengths and widths that is easy to assemble and disassemble. The present invention can expedite the manufacturing, and does not occupy too much space for transportation, and also can form a rack of antique style with curved edges.

In summation of the above description, the improved cabinet assembly according to the present invention definitely having the effects of the antique style, easy-to-assemble, not occupying too much space for the transportation, and improve consumer's willingness to use herein enhances the performance than the conventional structure and further complies with the patent application requirements and is submitted to the Patent and Trademark Office for review and granting of the commensurate patent rights.

While the improved cabinet assembly in accordance of the present invention has been described in connection with what is considered the most practical and preferred embodiment, it is understood that the invention is not limited to the disclosed embodiments but is intended to cover various arrangements included within the spirit and scope of the broadest interpretation and equivalent arrangements.

What is claimed is:

1. A cabinet assembly comprising:

a) a plurality of flat pieces having a plurality of holes, with at least one hole located in each of two opposing ends thereof; and b) a plurality of connecting members, each of the plurality of connecting members is connected between two of the plurality of flat pieces and having:

i) a main body having a curved cross section and two sides;

ii) at least one rib protruding outwardly from a curved exterior surface of the main body and connected at opposing ends thereof to each of the two sides; and iii) a plurality of protruding pillars, at least one of the plurality of protruding pillars extending outwardly from each of the two sides of the main body, each of the plurality of protruding pillars aligning with and being inserted into one of the at least one hole of one of the plurality of flat pieces.

2. The cabinet assembly according to claim 1, further comprising a plurality of cover boards, each of the plurality of cover boards having a curved cross section and connected to the main body and covering the at least one rib of the connecting member.

3. The cabinet assembly according to claim 1, further comprising:

a) at plurality of fixing protruding pillars extending inwardly from an inner surface of at least two flat pieces of the plurality of flat pieces; and b) a partition board supported by the plurality of fixing protruding pillars.

* * * * *